US008117708B2

(12) United States Patent
Kim

(10) Patent No.: US 8,117,708 B2
(45) Date of Patent: Feb. 21, 2012

(54) COSMETIC BRUSH

(76) Inventor: Joung Chul Kim, Wonmi-gu (KR)

( * ) Notice: Subject to any disclaimer, the term of this patent is extended or adjusted under 35 U.S.C. 154(b) by 11 days.

(21) Appl. No.: 12/439,503

(22) PCT Filed: Aug. 30, 2007

(86) PCT No.: PCT/KR2007/004192

§ 371 (c)(1),
(2), (4) Date: Feb. 27, 2009

(87) PCT Pub. No.: WO2008/026890

PCT Pub. Date: Mar. 6, 2008

(65) Prior Publication Data

US 2010/0143023 A1 Jun. 10, 2010

(30) Foreign Application Priority Data

Aug. 31, 2006 (KR) ..... 10-2006-0083214

(51) Int. Cl.
*A46B 7/02* (2006.01)

(52) U.S. Cl. ..... 15/184; 15/169

(58) Field of Classification Search ..... 15/184; 132/313, 317, 318, 320; 401/183, 269, 270; *A45D 40/18, 40/24, 40/26, 44/18; A46B 17/04*
See application file for complete search history.

(56) References Cited

U.S. PATENT DOCUMENTS

| | | | | |
|---|---|---|---|---|
| 1,725,464 | A * | 8/1929 | Lysons | 401/288 |
| 5,339,483 | A * | 8/1994 | Byun | 15/184 |
| 6,039,052 | A | 3/2000 | Choi | |
| 6,363,948 | B2 | 4/2002 | Choi | |
| 6,418,939 | B1 | 7/2002 | Byun | |
| 6,935,802 | B1 * | 8/2005 | Byun | 401/278 |
| 6,976,283 | B2 * | 12/2005 | Choi | 15/184 |

FOREIGN PATENT DOCUMENTS

JP 20057141 1/2005

* cited by examiner

*Primary Examiner* — Monica Carter
*Assistant Examiner* — Stephanie Newton
(74) *Attorney, Agent, or Firm* — Booth Udall, PLC

(57) ABSTRACT

The present invention relates to a cosmetic brush in which the protrusion and retraction of a brush head is accomplished using a pushing bar in order to prevent the brush head from being damaged while the brush head protrudes from and retracts into a main body.

The cosmetic brush includes a main body having an exit on a front side thereof and an insertion portion on a back side, an object member including a brush head which protrudes from and retracts into the main body through the exit, a pushing bar enabling the brush head to protrude from the main body, and a cover usually covering the exit of the main body and enabling the brush head to be protruded from the main body by a pushing bar.

5 Claims, 2 Drawing Sheets

[Fig. 1]
[ 20 : 21,23 ]
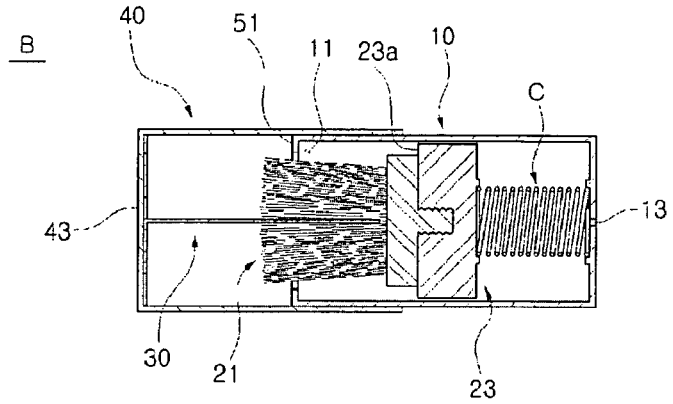
[Fig. 2]
[ 20 : 21,23 ]
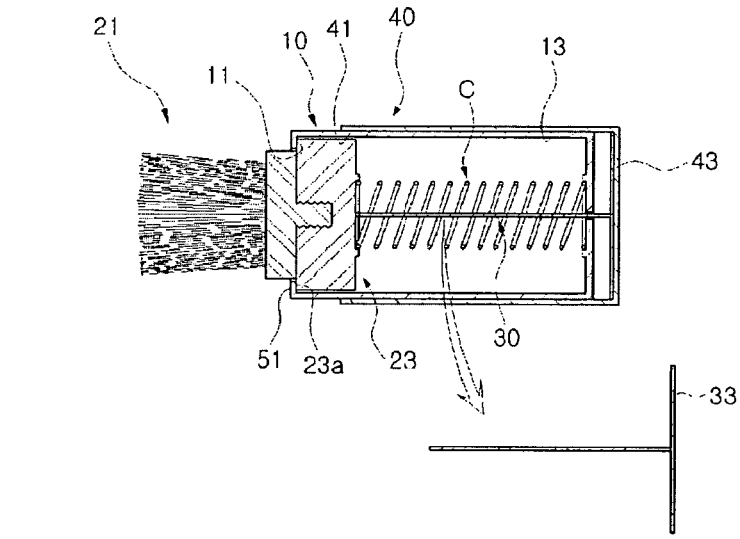
[Fig. 3]
[ S : S1,S2 ]
[ S1 : (23a,51),(27,53A) ]
[ S2 : 53A,53B ]
[ 20 : 21,23 ]
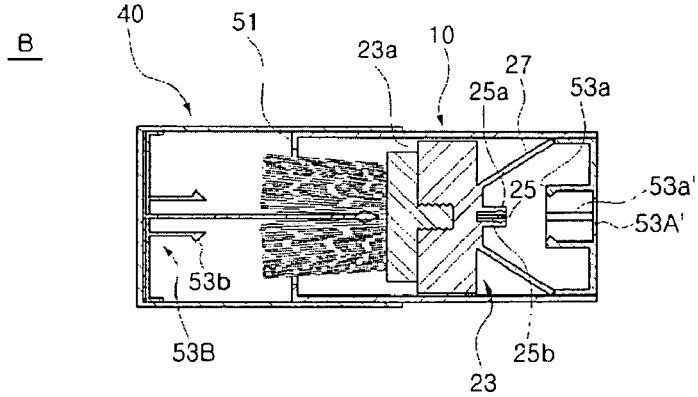

[Fig. 4]
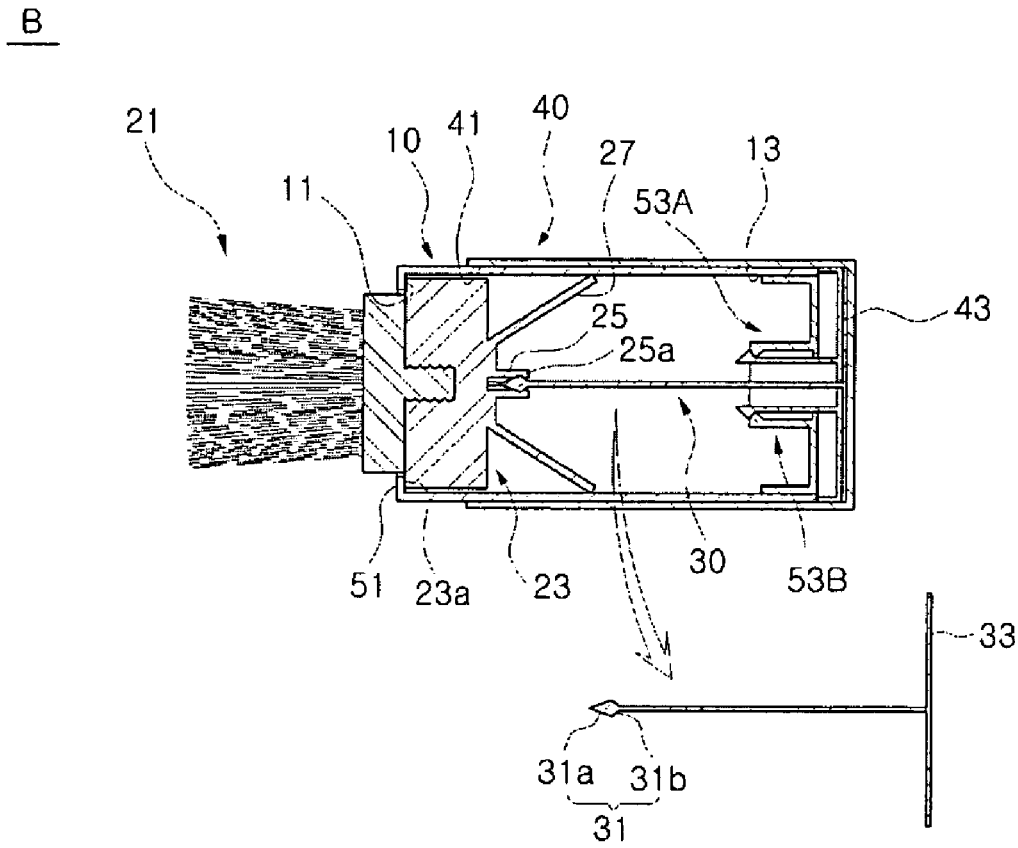

COSMETIC BRUSH

TECHNICAL FIELD

The present invention relates to a cosmetic brush which is used to apply make-up to lips, eyebrows, eyelids, and cheeks, and more particularly to a cosmetic brush having a pushing bar due to which a brush head protrudes and retracts, the cosmetic brush having advantages in that it is possible to prevent the brush head from being damaged when the brush head protrudes and retracts, it has a simple structure and is manipulated in a simple manner, resulting in a competitive price, it is easy to carry because it is short, and it is convenient for those who are not familiar with tools and machines to use.

BACKGROUND ART

There are a number of kinds of cosmetic brushes. One kind of cosmetic brush has a structure in which a brush head is covered and uncovered by motions of opening and closing a cover.

Korean Utility Model Registration No. 0400077 (Oct. 25, 2005) discloses a cosmetic brush tool in which a brush head protrudes forward out of a handle bar so as to be disposed outside the handle bar and retracts backward into the handle bar so as to be received in the handle bar.

Korean Utility Model Publication No. 1982-0000865 (Apr. 26, 1982) discloses a cosmetic brush having a structure which is a slight modification of a general ballpoint pen structure. In this cosmetic brush, if a brush bar encased in a casing is pushed forward, a brush head is exposed as a coil spring contracts. Conversely, if a hook button is pressed, restricting force applied to the coil spring is lifted and thus the brush head retracts into the housing.

There is another disclosure relating to a ballpoint pen type cosmetic brush in addition to that of Korean Utility Model Publication No. 1982-0000865. Specifically, Korean Utility Model Registration No. 0304043 (Jan. 30, 2003) discloses a cosmetic lip brush having a ballpoint pen structure invented by applying the ballpoint protruding and retracting mechanism adapted in general ballpoint pens to cosmetic brushes.

The above cosmetic brushes disclosed in the above-mentioned documents (Korean Utility Model Publications and Utility Model Registrations) have a structure in which a ballpoint portion of a ballpoint pen is replaced with a brush portion. Accordingly, hair on the outer side of the brush portion is easily cut or bent because of the friction between the hair and the coil spring. Thus, after a long period of use, the brush is damaged and the quality of the brush deteriorates. That is, the value of the brush as a product becomes low.

Korean Utility Model Registration No. 0310261 (Jun. 27, 2003) discloses a cosmetic brush assembly which is provided in order to overcome the problems of the cosmetic brush disclosed in Korean Utility Model Registration No. 0304043. That is, in order to solve the problem in which a pusher retracts without any resistance from the state of being protruded, an additional coil spring, which can elastically support a back portion of the pusher, is employed.

However, this cosmetic brush still has a problem in that the hair on the outer side of the brush portion is damaged by the coil spring disposed in the lower position of the brush.

In order to solve the problems encountered in the use of the cosmetic brushes disclosed in the above two utility models, Korean Utility Model Registration No. 0181122 (Feb. 24, 2000) discloses a cosmetic brush having a double spring structure.

In the cosmetic brush disclosed in Korean Utility Model Registration No. 0181122, a spring is located at a back portion while the spring is located close to the brush portion in the disclosures of Korean Utility Model Registration No. 0304043 and Korean Utility Model Registration No. 0310261.

Further, according to the cosmetic brush disclosed in Korean Utility Model Registration No. 0181122, a pusher is always elastically supported by an additional spring, and the pusher can protrude forward and retract backward without resistance.

However, the cosmetic brush disclosed in Korean Utility Model Registration No. 0181122 has disadvantages in that it has a complex structure because it employs two springs, it has very limited design flexibility with respect to the appearance thereof, and it is difficult to employ a brush with a small diameter.

As a result, the manufacturing cost of the cosmetic brush is increased.

Reducing the manufacturing cost is a matter of life and death for brush manufacturers who supply brushes to large cosmetics companies, when considering the brush distribution condition that the brushes are generally provided to customers for free. Accordingly, any increase in the manufacturing cost is fatal to existence of the brush manufacturers.

DISCLOSURE

Technical Problem

The present invention is made in view of the above mentioned problems, and thus there is provided a cosmetic brush that is easy to use, can be manufactured at low cost, and can reduce damage caused to a brush head thereof. The cosmetic brush overcomes problems generally encountered in ballpoint-type cosmetic brushes, related to a cost increase attributable to the complex structure and the damage of the brush head attributable to a spring.

An object of the invention is to provide a cosmetic brush in which the protrusion and retraction of an object member including a brush head are accomplished using a pushing bar coupled to a cover so that the cosmetic brush has a simple structure, operates reliably, and has a structure that makes it difficult to cause damage to the brush head.

The cosmetic brush includes a retracting unit which is used to draw back the brush head into the main body after the object member is pushed outward for the brush head to be exposed outside and used to apply make-up.

The retracting unit may be a coil spring connected between the back surface of the brush head and to the main body.

Alternatively, the retracting unit may be implemented as a pushing bar that pushes the back end of the brush head when the cover covers an exit of the main body.

In a further alternative manner, protrusion and retraction of the brush head can be accomplished in the following manner: an inserting protrusion having a narrow front portion and a wider back portion is pinched by an elastic hook member of a groove member formed in a guide block of the object member; when the pushing bar is drawn back, the brush head also retracts and the guide block is stopped by a back portion of the main body; and in this state, when the pushing bar is drawn back further, the elastic hook member opens so as release the inserting protrusion of the pushing bar.

The invention provides stopping means ensures the stability of both a state in which the brush head of the object member is exposed outside by protruding from the main body and a state in which the brush head is received in the main body.

The stopping means includes a stopping member that restricts the movement range of the object member and a stiffening member, which prevents the cover from being separated from the front side or the back side of the main body.

Technical Solution

In order to accomplish the above-mentioned objects of the invention, there is provided a cosmetic brush including a main body having an exit on a front side thereof and an insertion portion on a back side thereof, an object member including a brush head which protrudes from and retracts into the main body through the exit and which is disposed on the front side of the main body, a pushing bar enabling the brush head to protrude from the main body, and a cover usually serving as a cover when it is coupled to an exit side of the main body and enabling the brush head to protrude from the main body when it is coupled to an insertion portion side of the main body by the pushing bar.

In the cosmetic brush, it is preferable that the cosmetic brush further include a retracting unit for the brush head of the object member, which is exposed outside.

In the cosmetic brush, it is preferable that the retracting unit be a coil spring connected between the back surface of the brush head and the main body.

In the cosmetic brush, it is preferable that the retracting unit be implemented as the pushing bar, which pushes back the brush head when the cover covers the exit of the main body.

In the cosmetic brush, it is preferable that the retracting unit include a groove provided in the back surface of a guide block, which is an element of the object member and is connected to the brush head on the back side, and an inserting protrusion which is provided to an end of the pushing bar, which is engaged with the groove, and which has a shape having a wider front end portion and a narrower back end portion.

In the cosmetic brush, it is preferable that the cosmetic brush further include stopping means which ensures the stability of both a state in which the brush head of the object member is protruded from the main body through the exit and a state in which the brush head is received in the main body.

In the cosmetic brush, it is preferable that the stopping means include a stiffening member which prevents the cover, coupled to the front portion or the back portion, from being separated from the main body.

In the cosmetic brush, it is preferable that the stiffening member include an elastic pinching member provided to the main body or the cover, and a pinched member provided to the main body or the cover and engaged with the elastic pinching member.

In the cosmetic brush, it is preferable that the stiffening member be implemented in the shape of the cover, which has a narrower front portion and a wider back portion.

ADVANTAGEOUS EFFECT

As described above, since the protrusion and retraction of the object member including the brush head, which is received in the main body and moves forward and backward, are accomplished using the pushing bar coupled to the cover, the cosmetic brush has a simple structure and performs reliable operations, and furthermore, the brush head is not damaged.

When retracting the brush head so as to receive it in the main body after the brush head is protruded from the main body and used to apply make-up, since the inserting protrusion, having a narrow front portion and a wider back portion, is pinched by the elastic hook member of the groove member formed in the guide block of the object member, protrusion and retraction of the brush head can be accomplished in the following manner: when the pushing bar is drawn back, the brush head also retracts and the guide block is stopped by a back portion of the main body, and in this state, when the pushing bar is forcefully drawn back further, the elastic hook member opens so as release the inserting protrusion of the pushing bar.

As a result, it is possible to realize a competitive price. Further the cosmetic brush is easy to carry thanks to its short length.

The cosmetic brush according to the invention is relatively convenient to use in comparison with known cosmetic brushes. The invention minimizes damage to the brush head. The invention overcomes the problems with known ballpoint pen-type cosmetic brushes, namely problems of the damage to the brush head attributable to the spring and the high manufacturing cost attributable to the structure complexity. Accordingly, the invention has high industrial value.

DESCRIPTION OF DRAWINGS

FIGS. 1 and 2 are sectional views illustrating a cosmetic brush according to one embodiment of the invention; and FIGS. 3 and 4 are sectional views illustrating a cosmetic brush according to another embodiment of the invention.

BRIEF DESCRIPTION OF KEY ELEMENTS IN DRAWINGS

B: brush
10: main body
11: exit
13: insertion portion
20: object member
21: brush head
23: guide block
25: groove member
25*a*: elastic hook member
30: pushing bar
31: inserting protrusion
31: coupling disk
S1: stopping member
S2: stiffening member
51: ring-shaped protrusion
53A: elastic pinching member
53B: pinched member

BEST MODE

Hereinafter, the invention will be described with reference to the accompanying drawings.

In the drawings, references with like digits in the tens place and the units place are the same, or like digits in the tens place and the units place and like characters denote like elements having the same function. If there is no particular description, elements referenced by like references are to be understood based on such criteria.

In the description of a cosmetic brush B according to the invention, one direction is preliminarily specified first. With reference to FIGS. 1 and 2, an exit 11, through which a brush head 21 of an object member 20 protrudes and retracts back into a main body 10 of a brush B, is taken as the front side, and an insertion portion 13, through which a pushing bar 30 is inserted into the main body 10 in order to make the brush head 21 protrude from the main body 10, is taken as the back side.

With reference to FIGS. 1 and 2, the brush B according to the invention includes a main body 10, a cover 40, an object member 20 including a brush head 21, and a pushing bar 30 which functions to push the brush head 21 to cause it to protrude from the main body 10 through the exit 11 and to make the brush head 21 retract so as to be received in the main body 10.

Each of the main body 10 and the cover 40 has a cylindrical shape, but the invention is not limited thereto. That is, the main body 10 and the cover 40 may have arbitrary shapes.

The main body 10 has the exit 11 on the front side and the inserting portion 13 on the back side. The exit 11 is provided in order to allow the brush head 21 to move into and out of the main body 10, and the insertion portion 13 is provided in order to allow the pushing bar 41, which pushes the brush head 21 so as to expel it from the main body 10, to be inserted into the main body 10.

The object member received in the main body 10 is composed of the brush head 21 having a variety of sizes and shapes, and the guide block 23 disposed on the back side of the brush head 21.

The cover 40 is usually coupled to the main body 10 on the exit side and thus usually serves as a cover. However, when the cover is coupled to the main body 10 on the insertion portion side, the cover functions to push the brush head 21 so that the brush head 21 is located outside the main body 10 using the pushing bar 30 disposed inside the cover 40.

The front end 41 (opening) of the cover 40 is open but the back end (closed end) 43 of the cover 40 is closed. The front end and the back end are named following the convention in which the cover 40 is coupled to the insertion portion 13 side of the main body 10.

One end of the pushing bar 30 is fixedly coupled to the inside surface of the closed end 43 of the cover 40 using a coupling disk and an adhesive so that the pushing bar 30 is arranged in the center of the cover 40.

In the case in which the cover 40 is coupled to the back side of the main body 10, the pushing bar 30 pushes the back surface of the guide block 23 of the object member 20, so that the brush head 21, disposed inside the main body 10, is protruded from the main body 10.

If the cover 40 is separated from the main body 10, the pushing bar 30 does not push the brush head 21 any more.

There can be a retracting unit which allows the brush head 21 to retract so that the brush head 21 can be introduced into the main body 10 as the pushing bar 30 is moved backward.

With reference to FIGS. 1 and 2, the retracting unit is a coil spring connected between the back surface of the brush head 21 and the main body 10. The brush head 21 is introduced into the main body 10 as the coil spring pulls the brush head 21 backwards.

Also needed is stopping means which ensures the stability of the brush head of the object member in the state in which the brush head 21 is disposed outside the main body 10 or in the state in which the brush head 21 is received in the main body 10 shown in FIGS. 1 and 2. A variety of types of stopping means are shown in FIGS. 3 and 4.

The coil spring C serving as the retracting unit may be replaced with an inserting protrusion having a shape with a wider front end and a narrower back end and a groove member, which will be described below.

Next, a brush B according to another embodiment will be described with reference to FIGS. 3 and 4.

In the brush B shown in FIGS. 3 and 4, the retracting unit, which draws back the brush head 21, which is disposed outside the main body 10, is composed of the inserting protrusion 31, having a wider front end and a narrower back end and being provided to the front end (referred to according to the convention in which the cover is coupled to the insertion portion side of the main body 10) of the pushing bar 30, and a groove member 25 disposed on the back side of the guide block 23 of the object member 20 and engaged with the inserting protrusion 31.

The inserting protrusion 31 provided to the front end of the pushing bar 3 includes an inclined portion (front portion) 31*a*, the sectional area of which increases from the front side to the back side thereof, and a separation preventing portion 31*b* provided to the back end of the inclined portion 31, the separation preventing portion having a slanted surface having a steep slope or being at a right angle to the direction of the pushing bar 30.

The groove member 25, into which the inserting protrusion 31, provided to the front end of the pushing bar 30, is inserted, is formed at the guide block 23 of the object member 20.

The groove 25 must be provided with an elastic hook member 25*a* around a perimeter thereof in order to securely hold the inserting protrusion 31 and properly release the inserting protrusion 31. The inserting protrusion 31 and the groove member 25 have corresponding shapes.

The elastic hook member 25*a* is formed by a cut portion 25*b* (indicated by a hidden line in FIG. 1) (two or more cuts formed in a cylinder) formed around the groove member 25 of the guide block 23.

The elastic hook member 25*a* has an elastic force like a leaf spring due to the intrinsic elasticity of the material (a general synthetic material) of the guide block 23.

When the pushing bar 30 is engaged with the groove member 25 of the guide block 23 in order to protrude the brush head 21 of the object member 20 out of the main body 10, as the inclined portion 31*a* of the inserting protrusion 31 advances into the groove member 25, the elastic hook member 25*a* opens, and thus the inclined portion 31*a* can be easily inserted into the groove member 25.

If the separation preventing portion 31*b* is received in the groove member 25 after the inclined portion 31*a* of the inserting protrusion 31 is inserted into the groove member 25, the elastic hook member 25*a* tends to recover its original shape, thereby tightly pinching the inserting protrusion 31.

The state in which the inserting protrusion 31 perfectly engages with the groove member 25 may be the state in which a ring-type jaw 23*a* of the guide block 23 of the object member 20 is hooked by a ring-shaped protrusion 51 formed at the front end of the main body 10, which serves as a stopping member of the stopping means so the pushing bar 30 cannot advance any further but the pushing bar 30 is still pushed, after the object member 20 is fully pushed by the pushing bar 30 and thus the brush head 21 is completely pushed out of the main body 10.

Accordingly, the elasticity of the elastic hook member 25*a* and the coupling structure between the inserting protrusion and the groove member 25 must be properly determined in a manner such that the retracting unit continues to hold the object member 20 until the brush head 21 retracts into and is received in the main body 10 when the pushing bar 21 is drawn back after the brush head 21 is used.

If the cover 40, i.e. the pushing bar 30, is continuously drawn back even after the brush head 21 is completely received in the main body 10 due to the motion of the pushing bar 30, back ends of a plurality of elastic pieces 27, which are sloped from the front side to the back side thereof, elastically supports the inside surface of the main body 10, contributing to a stable fixing structure, and making the object member 20 stiffly move, are stopped by the stopping member (the elastic pinching member 53A) and the object member 20 cannot move back any further. Accordingly, if the pushing bar 30 is continuously drawn back in such state, the elastic hook member 25*a* of the guide block 23 opens, and thus the inserting protrusion 31 of the pushing bar 30 can be released from the groove member 25.

For easier separation of the inserting protrusion 31 from the groove member 25, it is preferable that the separation preventing portion 31*b* of the inserting protrusion 31 of the pushing bar 30 have a tilted structure with a larger slope than the inclined portion 31*a*. The separation preventing portion 31*b* is slanted in a manner such that the sectional area thereof decreases from the front side to the back side (according to the convention in which the cover is coupled to the insertion portion side of the main body) rather than having a right angle relative to the longitudinal direction of the pushing bar 30.

If the cover 40 is coupled to the exit side of the main body 10, it is possible to prevent the brush head 21 from being damaged and contaminated by foreign matter introduced into the main body through the exit 10.

According to this embodiment, the pushing bar 30 sticks into the center of the brush head 21 of the object member 20 in the case in which the hair is bunched in the brush head 21.

However, in the case in which the hairs are attached to each other by an adhesive, the dimensions of the main body, the brush head, the pushing bar, and the cover are adjusted in a manner such that the pushing bar is not aligned with the brush head.

Hereinafter, the stopping means S, which maintains both the state in which the brush head 21 of the object member 20 is protruded from the main body 10 through the exit 11 and the state in which the brush head 21 of the object member 20 is received in the main body 10, will now be described.

The stopping means S includes a stopping member S1 which defines the boundaries of the range of forward and backward motion of the object member 20 protruding and retracting inside the main body 10.

As shown in FIGS. 3 and 4, the stopping member S1, which prevents the object member 20 from being separated from the front end of the main body 10 and restricts the protruding length of the brush head 21, is composed of the ring-shaped protrusion 51 provided to the inside surface of the main body 10 near the exit 11 and the ring-shaped jaw 23*a* provided to the back end of the guide block 23 of the object member 20.

The ring-shaped protrusion 51 is generally formed so as to be perpendicularly bent inward or slightly curved inward from the back end of the guide block 23 when processing the aluminum brush casing.

Leaf springs are provided to the inside surface of the main body 10 near the exit 11, thereby reducing the inner diameter of the main body 10. Accordingly, the guide block 23 of the object member 20 stiffly advances when it reaches the space in which the leaf springs are arranged.

As a result, it is possible to prevent the ring-shaped jaw 23 from colliding with the ring-shaped protrusion 51, and thus it is possible to prevent the ring-shaped jaw 23 and the ring-shaped protrusion 51 from being damaged and noise from occurring.

The stopping member S1, which prevents the object member 20 from being separated from the back end of the main body 10 and helps the inserting protrusion 31, associated with the groove 25, be separated from the groove 25, is composed of an elastic pinching member 53A serving as a stiffening member S2 preventing the cover 40, coupled to the back end of the main body 10, from being decoupled, and an elastic piece 27 of the guide block 23, which is hooked by an outer sleeve of the elastic pinching member 53A.

The stiffening member S2 prevents the cover 40 from being decoupled from the front end or the back end of the main body 10. Accordingly, the stiffening member S2 can prevent the brush head 21 from being damaged or contaminated with foreign matter as the cover 40 is unintentionally separated from the main body while the brush B is not being used, or is being carried. The stiffening member S2 can further prevent the brush head 21, which is in the state of being outside the main body 10 and being used to apply make-up, from retracting into the main body 10, thereby ensuring convenience and reliability of use. The stiffening member S2 is composed of the elastic pinching member 53A provided to the inside surface of the main body 10 near the back end of the main body 10 in order to prevent the cover 40 from being decoupled from the back end of the main body 10 by abrupt pressure and shocks, and a pinched member 53B provided to the back end (referred under the condition in which the cover is coupled to the back end of the main body) of the cover 40.

The pinching member 53A has elasticity due to a plurality of cut portions 52*a*' (preferably 3 or 4 cuts formed at equal intervals) and the intrinsic characteristic of a material, and has inward protrusions 53*a* at the end thereof.

The inward protrusions 53*a* are weakly engaged with outward protrusions 53*b* provided to the end of the pinched member 53B inserted into an inserting portion 53A' of the pinching member 53A, but the inward protrusions 53*a* and the outward protrusions 53*b* are not released from each other without the application of intentional force.

The pushing bar 30 is also inserted into the inserting portion 53A' of the pinching member 53A.

Even though not shown, the stiffening member may be implemented by the shape of the cover 40, i.e. the inner structure of the cover 40, which has a wider front end portion and a narrower back end portion.

In greater detail, the stopping means can be implemented by the relative relationship between the outer profile of the main body and the inner profile of the cover, i.e. between the sectional area of the outer shape of the main body and the sectional are of the inner shape of the cover. By this relative relationship, the main body and the cover are coupled to each other in a forced insertion manner so as to provide a stiff feeling, and thus the cover can be fixed at the proper position.

That is, such a stopping means imparts resisting force to the cover so that the cover coupled to the exit side of the main body cannot move backward any further, and the cover coupled to the inserting portion side of the main body cannot advance any further, and thus the cover is not separated from the main body by unintentional external force.

In greater detail, both the outer shape of the main body and the inner shape of the cover have an almost cylindrical shape. The outer shape of the main body is tapered in a manner such that the sectional area thereof decreases as it becomes nearer the front end thereof. The inner shape of the cover is tapered in a manner such that the sectional area thereof decreases as it becomes nearer the front end (under the convention in which the cover is coupled to the front exit side of the main body) thereof.

When the cover is coupled to the front portion or the back portion of the main body, the cover cannot move any further in the state in which the cover receives a predetermined length of the main body therein because the main body 10 is stuck inside the cover at a predetermined position.

In addition, if the inside surface of the cover is provided with the leaf springs, the cover and the main body can be coupled in a forced inserting manner even if the shapes of the cover and the main body precisely correspond to each other.

That is, thanks to such stopping means, the cover and the main body can be coupled and fixed at a predetermined position, and may not be unintentionally decoupled from each other.

The stopping member S1 and the stiffening member S2 of the stopping means S can be modified in a variety of forms, and a variety of implementations can be used in combination.

Even though this is not shown, it is preferable that a clip be provided to the main body or the cover so that the cosmetic brush is easy to carry and does not roll.

The clip can be provided to the outer surface of the cover 40.

In the brush B shown in the figures, the clip cannot be provided to the main body.

However, if the shape of the cover is modified in a manner such that the cover has a cut portion extending from the back end to the front portion (relative to the state in which the cover is coupled to the exit side of the main body), considering the state in which the cover is coupled to the back end of the main body, the clip can be provided to the back end of the main body. In this instance, the clip is received in the cut portion when the cover is coupled to the inserting portion side of the main body.

The invention claimed is:

1. A cosmetic brush, comprising:

a main body having an exit on a front side thereof and an insertion portion on a back side thereof;

an object member including;

a brush head which protrudes from and retracts into the main body through the exit and which is disposed on the front side of the main body; and a retracting unit comprising a groove in a back surface of a guide block connected to the brush head through the guide block, the groove comprising at least one elastic hook member therein having elasticity due to cut portions therein;

a pushing bar enabling the brush head to protrude from the main body, the pushing bar comprising an inserting protrusion on an end of the pushing bar which is engaged with the groove of the retracting unit, the inserting protrusion comprising a shape having a front end portion wider than its narrower back end portion;

a cover removably coupled to an exit side of the main body and enabling the brush head to protrude from the main body when it is coupled to the insertion portion of the main body by the pushing bar; and at least one elastic pinching member on at least one of the main body and the cover and a pinched member on the other of the at least one of the main body and the cover, the elastic pinching member physically engaging with the pinched member when the cover is secured to the back side of the main body;

wherein the main body comprises a stopping member at the front side which ensures stability of both a state in which the brush head of the object member is protruded from the main body through the exit and a state in which the brush head is received in the main body a stopping member.

2. The cosmetic brush according to claim 1, wherein the retracting unit is implemented as the pushing bar which pushes back the brush head when the cover covers the exit of the main body.

3. The cosmetic brush according to claim 1, wherein the stiffening member is implemented by a shape of the cover, which has a narrower front portion and a wider back portion.

4. The cosmetic brush according to claim 1, wherein the elastic pinching member comprises a plurality of cut portions.

5. The cosmetic brush according to claim 4, wherein the elastic pinching member comprises opposing inward protrusions at respective ends of each cut portion and the pinched member comprises opposing outward protrusions at an end thereof, the opposing inward protrusions engaging the opposing outward projections when the cover is secured to the back side of the main body.

* * * * *